US012780576B2

(12) United States Patent
Tsujimura et al.

(10) Patent No.: US 12,780,576 B2
(45) Date of Patent: Nov. 3, 2026

(54) MEDIUM PROCESSING DEVICE AND MEDIUM CONVEYING UNIT

(71) Applicant: BROTHER KOGYO KABUSHIKI KAISHA, Nagoya (JP)

(72) Inventors: Yuki Tsujimura, Konan (JP); Masatomo Yamaguchi, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 90 days.

(21) Appl. No.: 18/931,477

(22) Filed: Oct. 30, 2024

(65) Prior Publication Data

US 2025/0136395 A1 May 1, 2025

(30) Foreign Application Priority Data

Oct. 31, 2023 (JP) ..... 2023-186941

(51) Int. Cl.
*B65H 5/06* (2006.01)
*B65H 7/02* (2006.01)

(52) U.S. Cl.
CPC ..... *B65H 5/062* (2013.01); *B65H 7/02* (2013.01); *B65H 2301/443246* (2013.01); *B65H 2301/515* (2013.01)

(58) Field of Classification Search
CPC . Y10T 83/8822; Y10T 83/141; Y10T 83/145; Y10T 83/148; Y10T 83/162; B65H 5/062; B65H 5/066; B65H 7/02; B65H 2301/443246; B65H 2301/515; B65H 2301/00; B65H 2301/31; B65H 2301/312; B65H 2301/3124; B65H 2301/44324; B41J 13/02; B41J 13/025
See application file for complete search history.

(56) References Cited

U.S. PATENT DOCUMENTS

2012/0253503 A1 10/2012 Nakamura et al.
2014/0150618 A1 6/2014 Fujihara
2014/0260854 A1 9/2014 Tokura
2014/0293376 A1 10/2014 Tokura
2015/0174923 A1 6/2015 Yamada et al.
(Continued)

FOREIGN PATENT DOCUMENTS

JP 2010189135 A 9/2010
JP 2012206232 A 10/2012
(Continued)

*Primary Examiner* — Phong H Nguyen
(74) *Attorney, Agent, or Firm* — Scully, Scott, Murphy & Presser, P. C.

(57) ABSTRACT

A medium processing device includes: a conveying portion configured to convey a medium along a conveyance path; and a medium processing portion. The conveyance path includes: an upstream path; a downstream path; and a merging path including a processing position. The conveying portion includes a first roller pair arranged on the downstream path and a second roller arranged on the merging path. The first roller pair is configured to be set to a nip state during execution of a conveying operation to convey the medium from the merging path toward the downstream path. The first roller pair is configured to be set to a nip release state during execution of a medium processing operation while the medium is positioned at a nip position of the first roller pair.

14 Claims, 8 Drawing Sheets

(56) References Cited

U.S. PATENT DOCUMENTS

| | | | | |
|---|---|---|---|---|
| 2020/0016784 | A1 | 1/2020 | Sugiyama et al. | |
| 2021/0347589 | A1* | 11/2021 | Suzuki | B65H 5/305 |
| 2021/0371222 | A1* | 12/2021 | Miyachi | B65H 5/062 |
| 2022/0080753 | A1* | 3/2022 | Kitahara | B41J 11/70 |
| 2022/0234238 | A1 | 7/2022 | Kondo et al. | |
| 2022/0305690 | A1 | 9/2022 | Shikama et al. | |
| 2024/0367445 | A1* | 11/2024 | Wada | B41J 3/46 |

FOREIGN PATENT DOCUMENTS

| | | | |
|---|---|---|---|
| JP | 2014108464 | A | 6/2014 |
| JP | 2014178824 | A | 9/2014 |
| JP | 2014188603 | A | 10/2014 |
| JP | 2015120319 | A | 7/2015 |
| JP | 2018052018 | A | 4/2018 |
| JP | 2018171669 | A | 11/2018 |
| JP | 2019171542 | A | 10/2019 |
| JP | 2022115610 | A | 8/2022 |
| JP | 2022150785 | A | 10/2022 |

* cited by examiner

MEDIUM PROCESSING DEVICE AND MEDIUM CONVEYING UNIT

REFERENCE TO RELATED APPLICATIONS

This application claims priority from Japanese Patent Application No. 2023-186941 filed on Oct. 31, 2023. The entire content of the priority application is incorporated herein by reference.

BACKGROUND ART

The present disclosure relates to a medium processing device including a conveying portion configured to convey a medium and a medium processing portion configured to processes the medium, and a medium conveying unit configured to be attached to the medium processing device.

In a related art, a recording device includes a recording section configured to record on a medium. A paper inversion unit is detachably provided with respect to a mounting portion of the recording device. The paper is conveyed from a first conveyance path to a second conveyance path, and further conveyed to a downstream side by a conveyance driving roller so that an image is recorded on the paper in the recording section. Then, the paper is conveyed to an upstream side by the reversing rotation of the conveyance driving roller, and conveyed to a third conveyance path by a roller pair including an intermediate conveyance driving roller and a driven roller.

DESCRIPTION

When the medium is recorded by the recording section while the conveyance driving roller is rotated to convey the medium in a state in which the medium is positioned over the second conveyance path and the third conveyance path, the following problem may occur. For example, in a configuration in which the roller pair and the conveyance driving roller are rotated by driving different motors, since the driving of the two motors is not coordinated with each other, a conveyance load due to the roller pair which are not interlocked with the rotation of the conveyance driving roller acts on the medium, and recording accuracy may deteriorate.

An object of the present disclosure is to provide a medium processing device and a medium conveying unit capable of preventing the deterioration of a processing accuracy.

The present disclosure provides a medium processing device including: a conveying portion configured to convey a medium along a conveyance path; a medium processing portion configured to process the medium conveyed by the conveying portion; and a controller configured to control the conveying portion and the medium processing portion, in which the conveyance path includes: an upstream path; a downstream path; and a merging path on which the upstream path and the downstream path are to be merged, the merging path including a processing position at which the medium is processed by the medium processing portion, the conveying portion includes a first roller pair arranged on the downstream path and a second roller arranged on the merging path, wherein the controller is configured to execute: a medium processing operation to cause the medium processing portion to process the medium while rotating the second roller to convey the medium in a state in which the medium is positioned over the merging path and the downstream path; and a conveying operation to cause the first roller pair to rotate to convey the medium from the merging path toward the downstream path, the first roller pair is configured to be set to a nip state during execution of the conveying operation, and the first roller pair is configured to be set to a nip release state in which a nip force is smaller than that in the nip state during execution of the medium processing operation while the medium is positioned at a nip position of the first roller pair.

The present disclosure provides a medium conveying unit including: a first conveying portion configured to convey a medium along an upstream path and a downstream path; and a controller configured to control the first conveying portion, in which the medium conveying unit is configured to be attached to a medium processing unit, the medium processing unit including a second conveying portion configured to convey the medium along a merging path on which the upstream path and the downstream path are to be merged, and a medium processing portion configured to process the medium conveyed by the second conveying portion at a processing position provided on the merging path, the first conveying portion includes a first roller pair arranged on the downstream path, the second conveying portion includes a second roller arranged on the merging path, the controller is configured to execute a conveying operation to cause the first roller pair to rotate to convey the medium from the merging path toward the downstream path, the first roller pair is configured to be set to a nip state during execution of the conveying operation, and the first roller pair is configured to be set to a nip release state in which a nip force is smaller than that in the nip state during execution of a medium processing operation while the medium is positioned at a nip position of the first roller pair, the medium processing operation being executed to cause the medium processing portion to process the medium while rotating the second roller to convey the medium in a state in which the medium is positioned over the merging path and the downstream path.

The present disclosure provides a medium conveying unit configured to be attached to a medium processing unit, the medium conveying unit including: a first roller pair configured to convey a medium processed by the medium processing unit; and a third roller configured to convey the medium toward the medium processing unit, in which the first roller pair is configured to selectively taking a nip state or a nip release state in which a nip force is smaller than that in the nip state.

According to the present disclosure, since a conveyance load by the first roller pair during the execution of the medium processing operation is reduced, the conveyance does not become unstable, and deterioration of processing accuracy can be prevented.

Figure 1:
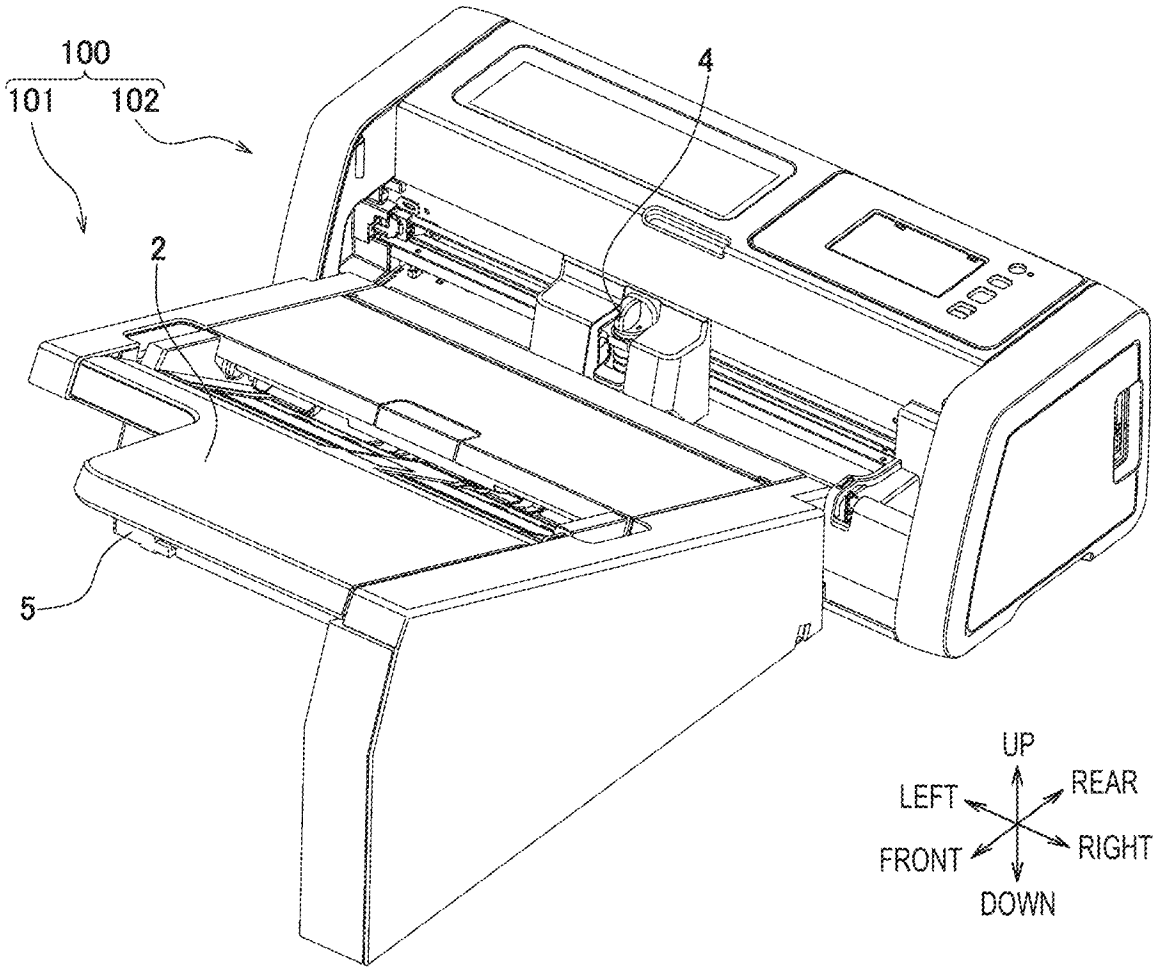
FIG. 1 is a perspective view of a cutting device according to an embodiment of the present disclosure.
Figure 2:
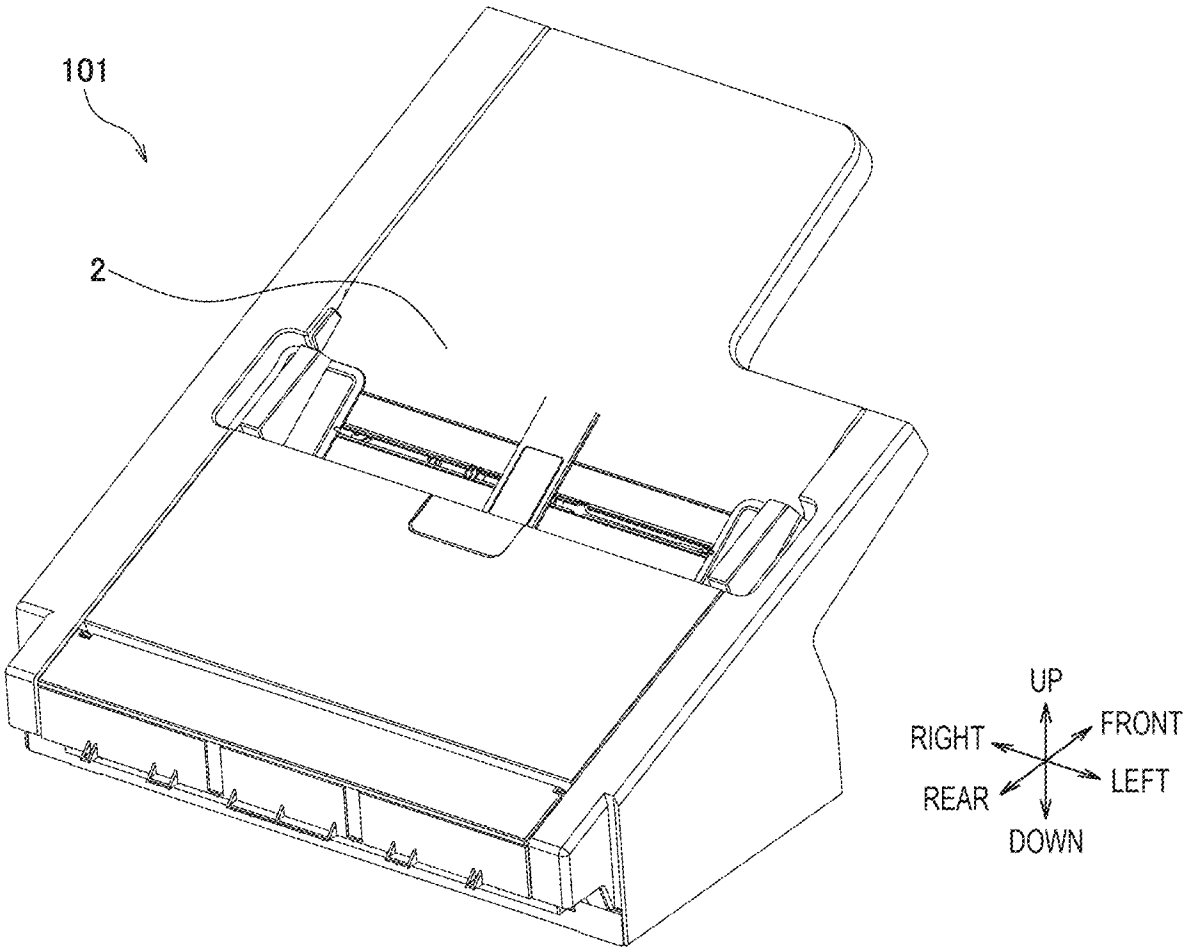
FIG. 2 is a perspective view of a conveying unit included in the cutting device of FIG. 1.
Figure 3:
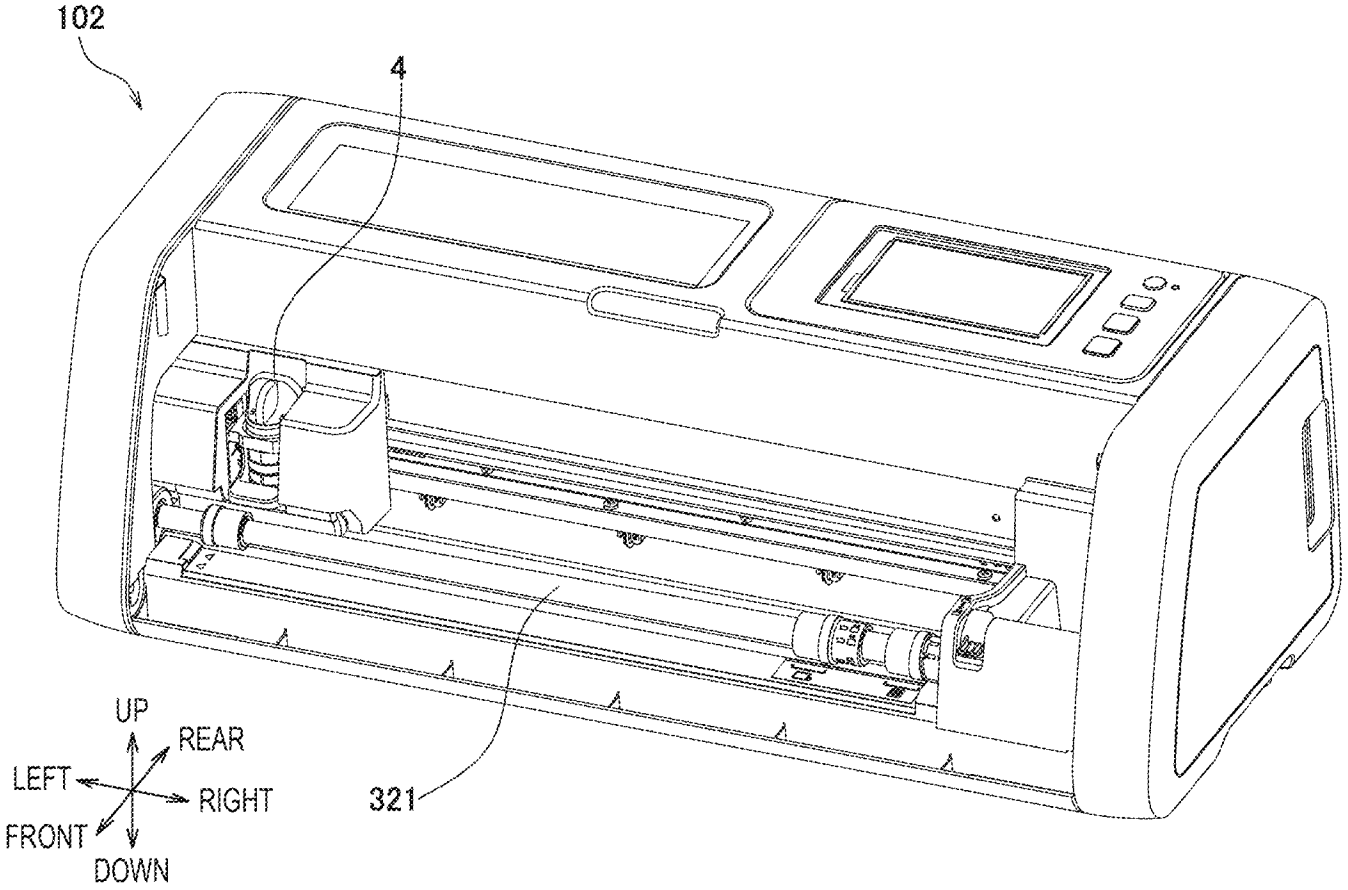
FIG. 3 is a perspective view of a cutting unit included in the cutting device of FIG. 1.
Figure 4:
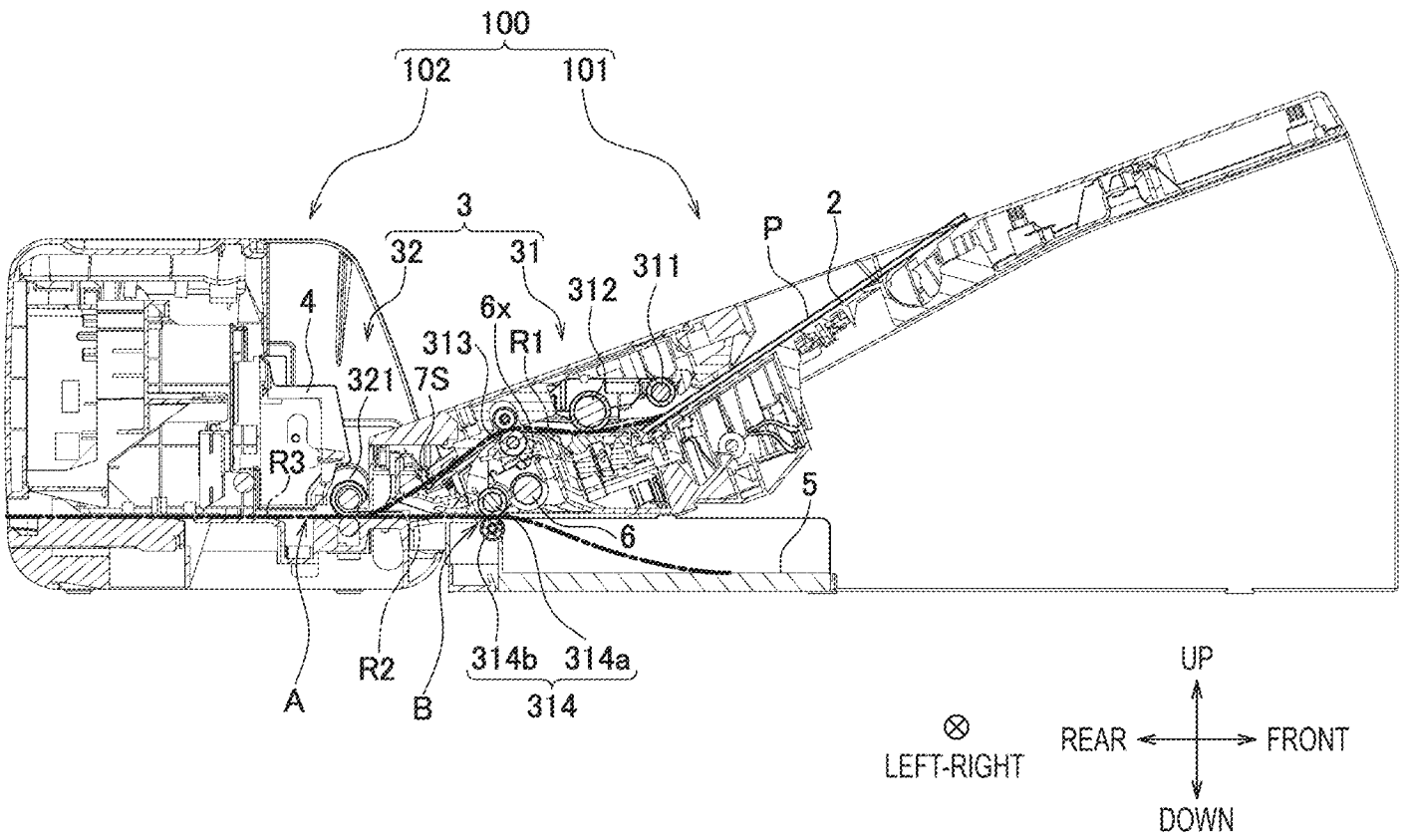
FIG. 4 is a longitudinal sectional view when a roller pair is in a nip state in the cutting device of FIG. 1.
Figure 5:
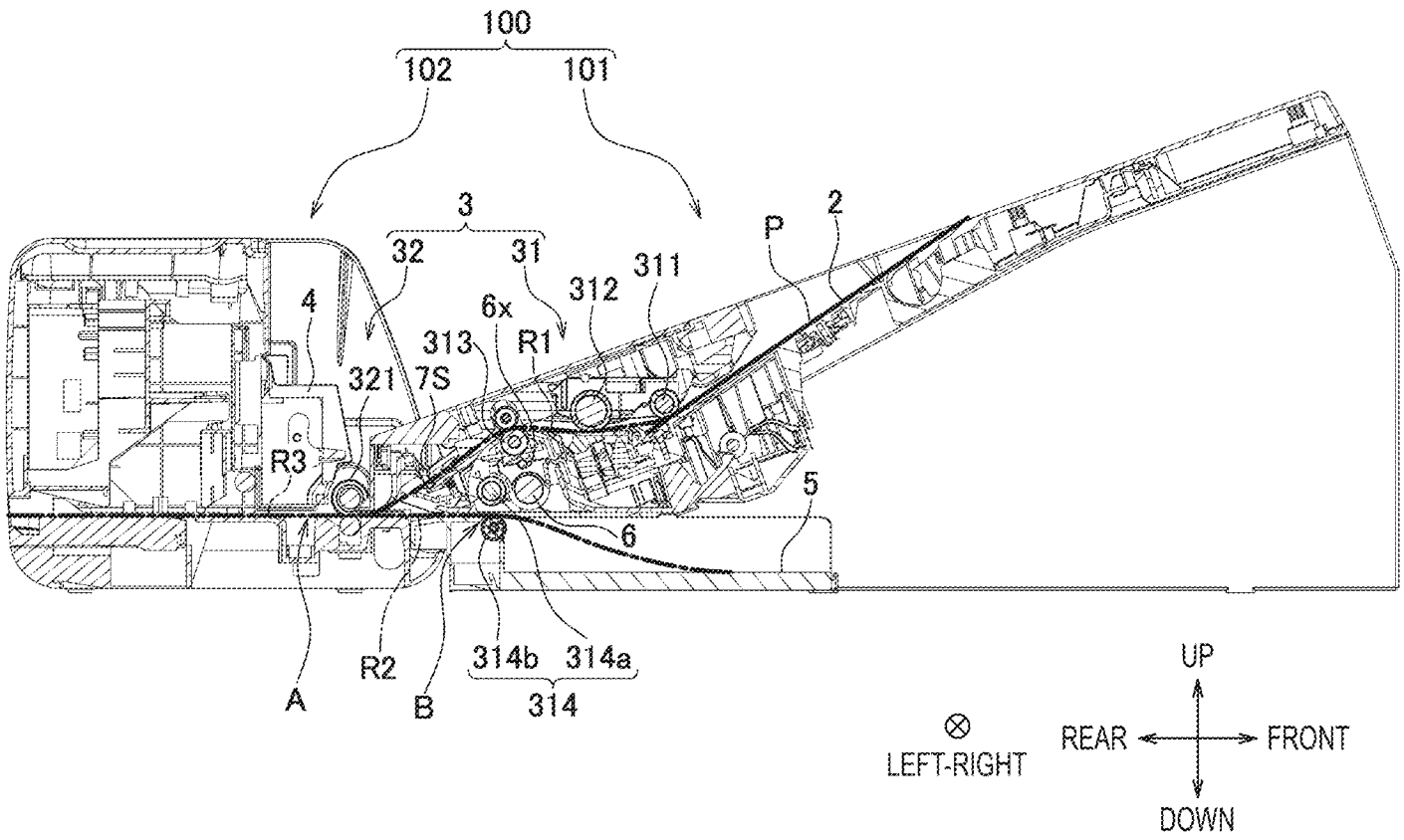
FIG. 5 is a longitudinal sectional view when the roller pair is in a nip release state in the cutting device of FIG. 1.

A cutting device 100 shown in FIGS. 1, 4, and 5 is an embodiment of a "medium processing device" according to the present disclosure. The cutting device 100 includes a conveying unit 101 (see FIG. 2) and a cutting unit 102 (see FIG. 3). The conveying unit 101 is an embodiment of a "medium conveying unit" according to the present disclosure. The cutting unit 102 is an embodiment of a "medium processing unit" according to the present disclosure.

The conveying unit 101 is attachable to and detachable from the cutting unit 102, that is, attachable to the cutting unit 102. In FIGS. 1, 4, and 5, the conveying unit 101 is fixed to a front end of the cutting unit 102 and is located in front of the cutting unit 102.

The conveying unit 101 includes a sheet feeding tray 2, a sheet discharging tray 5, a first conveying portion 31, a sheet sensor 7S, and a control device 80. The sheet feeding tray 2 and the sheet discharging tray 5 can support one or more sheets P. The sheet P corresponds to a "medium" of the present disclosure.

The conveying unit 101 is formed with an upstream path R1 along which the sheet P is conveyed from the sheet feeding tray 2 rearward in an oblique manner and toward the cutting unit 102, and a downstream path R2 along which the sheet P cut by the cutting unit 102 is conveyed forward and toward the sheet discharging tray 5. The upstream path R1 is located above the downstream path R2.

Figure 6:
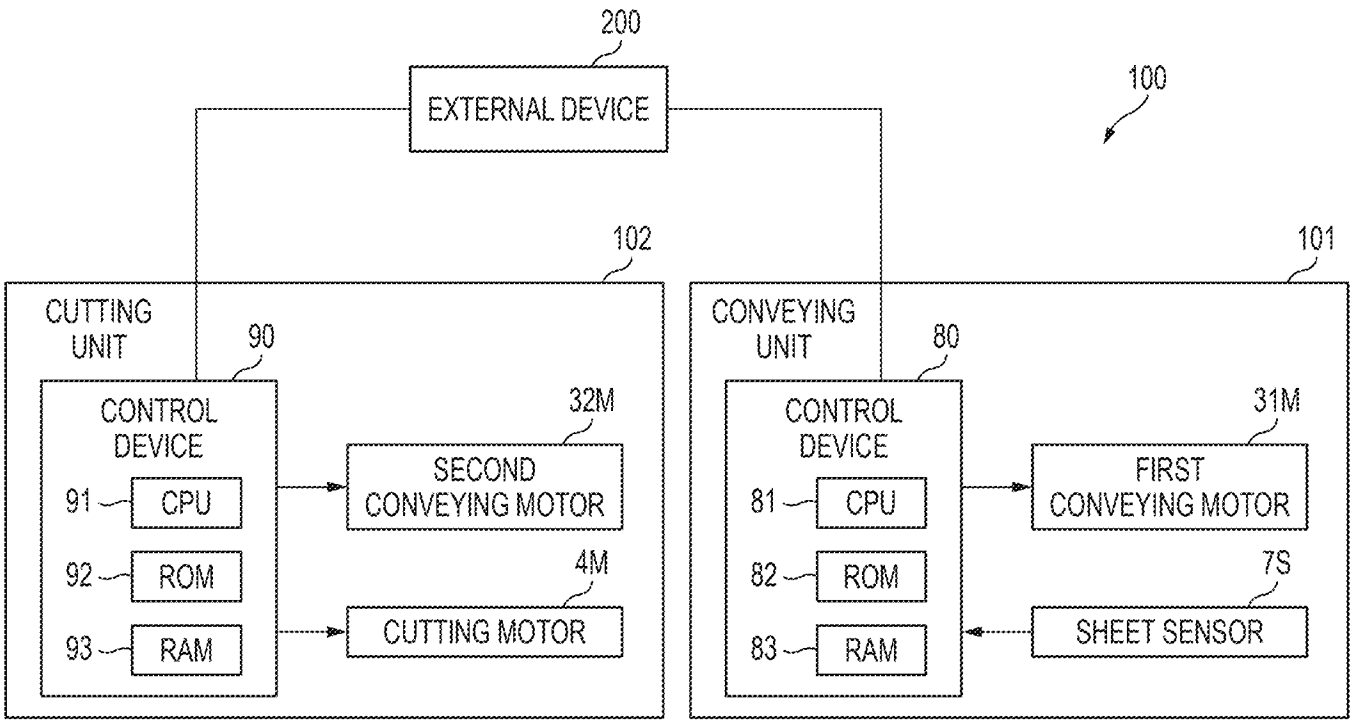
FIG. 6 is a block diagram showing an electrical configuration of the cutting device of FIG. 1.

The first conveying portion 31 includes rollers 311, 312, and 313 arranged on the upstream path R1, a roller pair 314 arranged on the downstream path R2, and a first conveying motor 31M (see FIG. 6).

The rollers 311, 312, and 313 convey the sheet P along the upstream path R1. Among the rollers 311, 312, and 313, the roller 311 is arranged at the foremost position (that is, a position farthest from the cutting unit 102), and the roller 313 is arranged at the rearmost position (that is, a position closest to the cutting unit 102). The roller 312 is located between the roller 311 and the roller 313 in a front-rear direction. The rollers 311, 312, and 313 correspond to a "third roller" of the present disclosure.

The roller pair 314 conveys the sheet P along the downstream path R2. The roller pair 314 includes an upper roller 314*a* and a lower roller 314*b*, and nips the sheet P at a nip position B. The roller pair 314 corresponds to a "first roller pair" of the present disclosure. The upper roller 314*a* corresponds to a "fourth roller" of the present disclosure. The lower roller 314*b* is located below the upper roller 314*a* and at a position at which the upper roller 314*a* is sandwiched between the lower roller 314*b* and the upstream path R1, and corresponds to a "fifth roller" of the present disclosure.

The rollers 311, 312, and 313 and the upper roller 314*a* are coupled to each other via a plurality of gears and coupled to the first conveying motor 31M (see FIG. 6).

The rollers 311, 312, and 313 and the upper roller 314*a* are rotated by driving the first conveying motor 31M.

Further, the roller 311 and the upper roller 314*a* move in an up-down direction by driving the first conveying motor 31M.

The roller 311 is lowered by driving the first conveying motor 31M to rotate in a forward direction (see FIG. 5), and is raised by driving the first conveying motor 31M to rotate in a reverse direction (see FIG. 4).

The upper roller 314*a* is raised by driving the first conveying motor 31M to rotate in the forward direction (see FIG. 5), and is lowered by driving the first conveying motor 31M to rotate in the reverse direction (see FIG. 4). Specifically, when the first conveying motor 31M rotates in the forward direction, a holding portion 6 holding the upper roller 314*a* rotates clockwise about a shaft 6*x* in FIG. 4, and the upper roller 314*a* is raised to reach a position shown in FIG. 5. When the first conveying motor 31M rotates in the reverse direction, the holding portion 6 rotates counterclockwise about the shaft 6*x* in FIG. 5, and the upper roller 314*a* is lowered to reach a position shown in FIG. 4.

In FIG. 4, the upper roller 314*a* and the lower roller 314*b* are in contact with each other, and the roller pair 314 is in a nip state.

In FIG. 5, the upper roller 314*a* and the lower roller 314*b* are separated from each other, and the roller pair 314 is in a nip release state.

A nip force of the roller pair 314 in the nip release state is smaller than a nip force of the roller pair 314 in the nip state.

The sheet sensor 7S outputs a signal indicating a presence or absence of the sheet P (either an ON signal indicating the presence of the sheet P or an OFF signal indicating the absence of the sheet P), which is located downstream of the roller 313 on the upstream path R1.

In the cutting unit 102, a merging path R3 on which the upstream path R1 and the downstream path R2 are merged is formed.

The cutting unit 102 includes a second conveying portion 32, a cutting portion 4, and a controller 90.

The first conveying portion 31 of the conveying unit 101 and the second conveying portion 32 of the cutting unit 102 form a conveying portion 3 of the cutting device 100. In addition, paths R1 and R2 of the conveying unit 101 and a path R3 of the cutting unit 102 form a conveyance path of the cutting device 100.

The second conveying portion 32 includes a roller 321 arranged on the merging path R3 and a second conveying motor 32M (see FIG. 6). The roller 321 corresponds to a "second roller" of the present disclosure. The roller 321 is coupled to the second conveying motor 32M. The roller 321 is rotated clockwise in FIG. 5 (in a direction in which the sheet P is conveyed rearward) by driving the second conveying motor 32M to rotate in the forward direction, and is rotated counterclockwise in FIG. 5 (in a direction in which the sheet P is conveyed forward) by driving the second conveying motor 32M to rotate in the reverse direction. That is, the second conveying portion 32 can convey the sheet P in a direction from the merging path R3 toward the downstream path R2 (forward) and a direction from the downstream path R2 toward the merging path R3 (rearward).

The cutting portion 4 cuts the sheet P at a cutting position A provided in the merging path R3. The cutting portion 4 includes a cutter, a traveling mechanism that travels to move the cutter in a left-right direction, and a cutting motor 4M (see FIG. 6), and corresponds to a "medium processing portion" of the present disclosure. The traveling mechanism travels by being driven by the cutting motor 4M. The cutting position A corresponds to a "processing position" of the present disclosure.

The control devices 80 and 90 include CPU 81 and 91, ROM 82 and 92, and RAM 83 and 93. The CPU 81 and 91 correspond to a "controller" of the present disclosure. The ROM 82 and 92 store programs and data for the CPU 81 and 91 to perform various controls. The RAM 83 and 93 temporarily store data used when the CPU 81 and 91 execute the programs.

The control device 80 of the conveying unit 101 is electrically connected to the first conveying motor 31M and the sheet sensor 7S.

The control device 90 of the cutting unit 102 is electrically connected to the second conveying motor 32M and the cutting motor 4M.

The control devices 80 and 90 are electrically connected to an external device 200 such as a PC to be able to communicate with each other.

Figure 7:
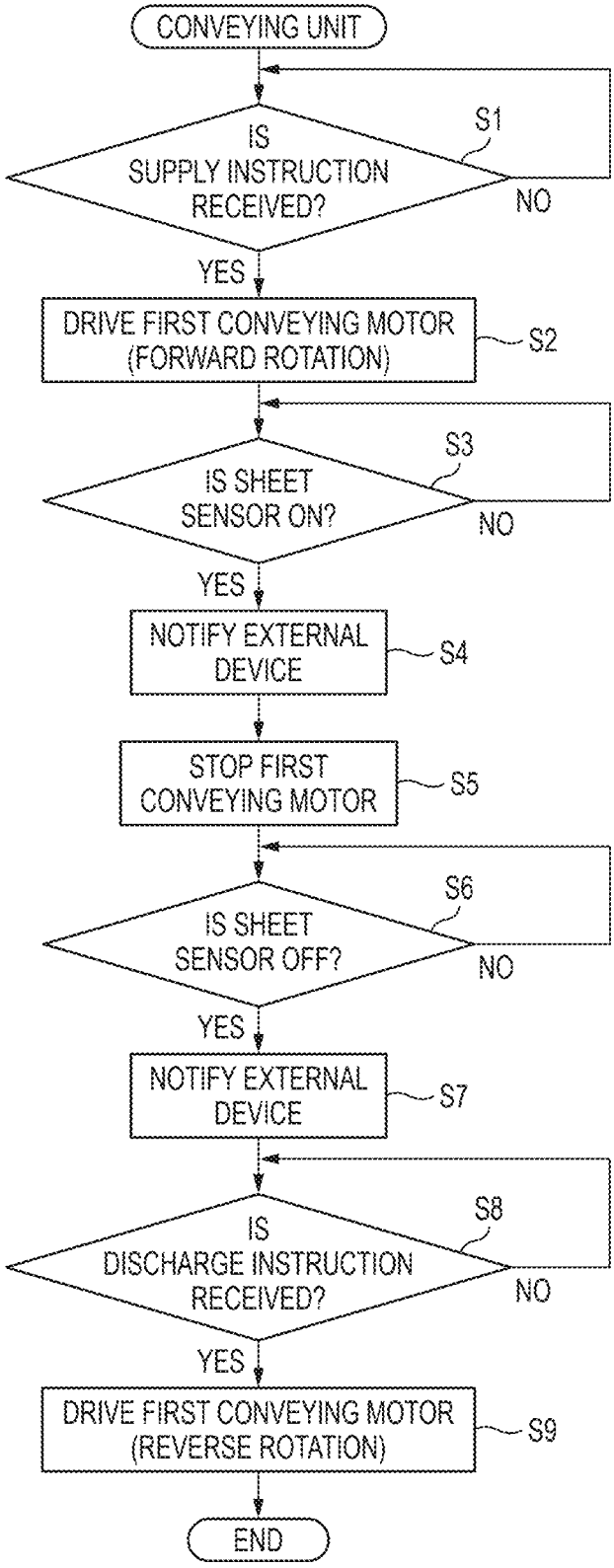
FIG. 7 is a flowchart showing a program executed by a CPU of the conveying unit included in the cutting device of FIG. 1.

Next, the program executed by the CPU 81 of the conveying unit 101 will be described with reference to FIG. 7.

At a start time point of the program, the rollers 311, 312, and 313 and the upper roller 314*a* are in a state shown in FIG. 4. That is, the roller pair 314 is in the nip state.

First, the CPU 81 determines whether a supply instruction is received from the external device 200 (S1).

When it is determined that the supply instruction is not received (S1: NO), the CPU 81 repeats the processing of S1.

When it is determined that the supply instruction is received (S1: YES), the CPU 81 drives the first conveying motor 31M to rotate in the forward direction in accordance with the instruction (S2).

Accordingly, the roller 311 is lowered from the position shown in FIG. 4 to the position shown in FIG. 5, and comes into contact with the uppermost sheet P in the sheet feeding tray 2. The upper roller 314*a* is raised from the position shown in FIG. 4 to the position shown in FIG. 5, and is separated from the lower roller 314*b*. That is, the roller pair 314 shifts from the nip state to the nip release state.

Further, since the rollers 311, 312, and 313 rotate in the state shown in FIG. 5, the uppermost sheet P in the sheet feeding tray 2 is conveyed toward the merging path R3 along the upstream path R1. At this time, the roller 311 rotates clockwise in FIG. 5 in a state in which the sheet P is sandwiched between the roller 311 and an upper surface of the sheet feeding tray 2, the roller 312 rotates clockwise in FIG. 5 in a state in which the sheet P is sandwiched between the roller 312 and a plate member arranged below the roller 312, and the roller 313 rotates counterclockwise in FIG. 5 in a state in which the sheet P is sandwiched between the roller 313 and a roller arranged above the roller 313.

After S2, the CPU 81 determines whether the ON signal is received from the sheet sensor 7S (S3).

When it is determined that the ON signal is not received from the sheet sensor 7S (S3: NO), the CPU 81 repeats the processing of S3.

When it is determined that the ON signal is received from the sheet sensor 7S (S3: YES), the CPU 81 notifies the external device 200 that the ON signal is received from the sheet sensor 7S (S4).

After S4, the CPU 81 stops the first conveying motor 31M after a predetermined time has elapsed from a time point when the ON signal is received from the sheet sensor 7S (S5). A timing at which the first conveying motor 31M is stopped is after a leading end of the sheet P reaches the roller 321. After the first conveying motor 31M is stopped, the rollers 311, 312, and 313 rotate as the sheet P is conveyed by the rotation of the roller 321 of the cutting unit 102 as described later.

After S5, the CPU 81 determines whether the OFF signal is received from the sheet sensor 7S (S6).

When it is determined that the OFF signal is not received from the sheet sensor 7S (S6: NO), the CPU 81 repeats the processing of S6.

When it is determined that the OFF signal is received from the sheet sensor 7S (S6: YES), the CPU 81 notifies the external device 200 that the OFF signal is received from the sheet sensor 7S (S7). At this time, the CPU 81 arranges a flap (not shown) provided at a branch point between the upstream path R1 and the downstream path R2 in the conveying unit 101 at a position to close the upstream path R1. Accordingly, the sheet P is prevented from being conveyed to the upstream path R1 during execution of a cutting step and a conveying step described later.

After S7, the CPU 81 determines whether a discharge instruction is received from the external device 200 (S8). The external device 200 sends a cutting instruction to the cutting unit 102 after the notification (S7) indicating that the OFF signal is received from the sheet sensor 7S is received from the conveying unit 101. After the cutting by the cutting unit 102 is completed, the external device 200 sends the discharge instruction to the conveying unit 101.

When it is determined that the discharge instruction is not received (S8: NO), the CPU 81 repeats the processing of S8.

When it is determined that the discharge instruction is received (S8: YES), the CPU 81 drives the first conveying motor 31M to rotate in the reverse direction in accordance with the instruction (S9).

Accordingly, the roller 311 is raised from the position shown in FIG. 5 to the position shown in FIG. 4, and is separated from the sheet P in the sheet feeding tray 2. The upper roller 314*a* is lowered from the position shown in FIG. 5 to the position shown in FIG. 4, and comes into contact with the lower roller 314*b*. That is, the roller pair 314 shifts from the nip release state to the nip state.

Further, when the roller pair 314 rotates in the state shown in FIG. 4, the sheet P is conveyed from the merging path R3 toward the downstream path R2 (conveying step). The conveying step corresponds to a "conveying operation" of the present disclosure. At this time, the roller pair 314 is maintained in the nip state, the upper roller 314*a* rotates counterclockwise in FIG. 4, and the lower roller 314*b* rotates clockwise in FIG. 5.

After S9, the CPU 81 stops the first conveying motor 31M after a predetermined time has elapsed from a time point when the first conveying motor 31M starts to drive in the reverse direction, and ends the program. A timing at which the CPU 81 stops the first conveying motor 31M is after the sheet P is received by the sheet discharging tray 5.

Figure 8:
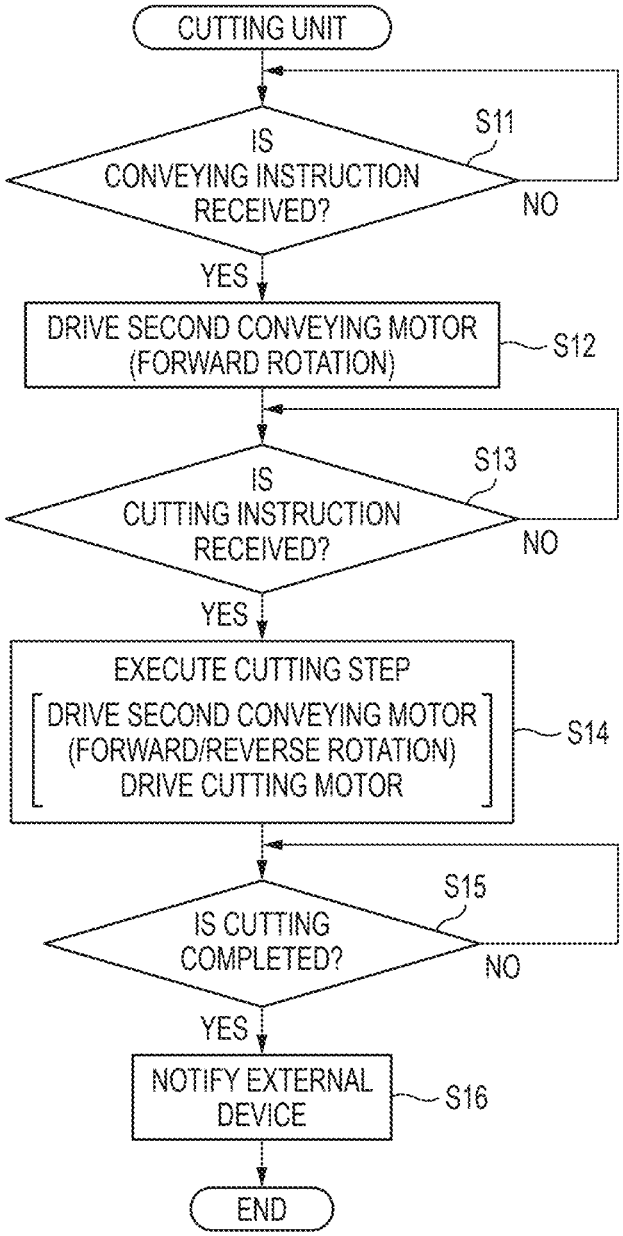
FIG. 8 is a flowchart showing a program executed by a CPU of the cutting unit included in the cutting device of FIG. 1.

Next, the program executed by the CPU 91 of the cutting unit 102 will be described with reference to FIG. 8.

First, the CPU 91 determines whether a conveying instruction is received from the external device 200 (S11). The external device 200 sends the conveying instruction to the cutting unit 102 after the notification (S4) indicating that the ON signal is received from the sheet sensor 7S is received from the conveying unit 101.

When it is determined that the conveying instruction is not received (S11: NO), the CPU 91 repeats the processing of S11.

When it is determined that the conveying instruction is received (S11: YES), the CPU 91 drives the second conveying motor 32M to rotate in the forward direction in accordance with the instruction (S12).

At this time, the roller 321 rotates clockwise in FIG. 5 in a state in which the sheet P is sandwiched between the roller 321 and a roller arranged below the roller 321. Thus, the sheet P conveyed from the upstream path R1 to the merging path R3 is conveyed rearward along the merging path R3.

After S12, the CPU 91 determines whether the cutting instruction is received from the external device 200 (S13). The external device 200 sends the cutting instruction to the cutting unit 102 after the notification (S7) indicating that the OFF signal is received from the sheet sensor 7S is received from the conveying unit 101.

When it is determined that the cutting instruction is not received (S13: NO), the CPU 91 repeats the processing of S13.

When it is determined that the cutting instruction is received (S13: YES), the CPU 91 executes the cutting step in accordance with the instruction (S14). The cutting step S14 corresponds to a "medium processing operation" of the present disclosure.

During the execution of the cutting step S14, the sheet P is positioned over the merging path R3 and the downstream path R2, and the roller pair 314 is maintained in the nip release state shown in FIG. 5. The CPU 91 selectively drives the second conveying motor 32M to rotate in the forward direction and to rotate in the reverse direction, and selectively rotates the roller 321 clockwise and counterclockwise in FIG. 5. Accordingly, the sheet P is selectively conveyed in the direction from the merging path R3 toward the downstream path R2 (forward) and in the direction from the downstream path R2 toward the merging path R3 (rearward).

In the cutting step S14, the CPU 91 drives the cutting motor 4M to cut the sheet P by the cutting portion 4 while conveying the sheet P by rotating the roller 321 as described above.

After S14, the CPU 91 determines whether the cutting is completed (S15).

When it is determined that the cutting is not completed (S15: NO), the CPU 91 repeats the processing of S15.

When it is determined that the cutting is completed (S15: YES), the CPU 91 notifies the external device 200 that the cutting is completed, and when the sheet P is not at a nip position B, the CPU 91 drives the second conveying motor 32M to rotate in the reverse direction until the sheet P is arranged at the nip position B to rotate the roller 321 counterclockwise in FIG. 5 (S16).

After S16, the CPU 91 ends the program.

As described above, according to the present embodiment, during the execution of the cutting step S14, the sheet P is positioned over the merging path R3 and the downstream path R2, and the roller pair 24 is maintained in the nip release state (see FIG. 5). That is, during the execution of the cutting step S14 and when the sheet P is positioned at the nip position B, the CPU 81 sets the roller pair 314 to the nip release state. Accordingly, since a conveyance load by the roller pair 314 during the execution of the cutting step S14 is reduced, the conveyance does not become unstable, and deterioration of cutting accuracy (processing accuracy) can be prevented.

The nip release state is a state in which the two rollers 314*a* and 314*b* forming the roller pair 314 are separated from each other (see FIG. 5). In this case, the nip force can be more reliably reduced compared to a case in which the two rollers 314*a* and 314*b* forming the roller pair 314 are not separated from each other. When the two rollers 314*a* and 314*b* forming the roller pair 314 are separated from each other, the curled sheet P is not inserted between the two rollers 314*a* and 314*b*, and a jam may occur. According to the present configuration, the problem can be prevented.

In the cutting step S14, the CPU 91 of the cutting unit conveys the sheet P in the direction from the merging path R3 toward the downstream path R2 (forward) and in the direction from the downstream path R2 toward the merging path R3 (rearward). When the sheet P is conveyed in two directions in this manner, in particular, the conveyance load by the roller pair 314 may be increased. In this regard, according to the present configuration, since the roller pair 314 is set to the nip release state in the cutting step S14, the conveyance load can be reduced even when the sheet P is conveyed in two directions.

The cutting device 100 according to the present embodiment includes the cutting portion 4 which cuts the sheet P as a medium processing portion. In this case, cutting pieces having various shapes can be formed by cutting the sheet P while conveying the sheet P in two directions.

The roller pair 314 and the rollers 311, 312, and 313 rotate by driving one motor (the first conveying motor 31M). In this case, the configuration can be simplified compared to a case in which the roller pair 314 and the rollers 311, 312, and 313 rotate by driving separate motors. The roller pair 314 can selectively take the nip state and the nip release state in accordance with the driving of the first conveying motor 31M. As a result, it is not necessary to provide a dedicated motor for switching the state of the roller pair 314, and the configuration can be further simplified.

when the roller pair 314 shifts from the nip state (see FIG. 4) to the nip release state (see FIG. 5), the upper roller 314*a* moves in a direction approaching the upstream path R1. In this case, components (the holding portion 6 and the like) related to switching of the state of the roller pair 314 can be arranged between the upstream path R1 and the downstream path R2, and the conveying unit 101 can be prevented from being enlarged in the up-down direction by an arrangement space of the components.

When receiving the supply instruction from the external device 200 (S1: YES), the CPU 81 drives the first conveying motor 31M to rotate in the forward direction (S2) and shifts the roller pair 314 from the nip state (see FIG. 4) to the nip release state (see FIG. 5). The timing is before the cutting step starts (S14). In this case, by setting the roller pair 314 to the nip release state before the cutting step starts, deterioration in the cutting accuracy can be more reliably prevented.

When receiving the discharge instruction from the external device 200 (S8: YES), the CPU 81 drives the first conveying motor 31M to rotate in the reverse direction (S9) and shifts the roller pair 314 from the nip release state (see FIG. 5) to the nip state (see FIG. 4). The timing is after the cutting step ends (S14) and before the conveying step starts (S9). In this case, the cut sheet P can be reliably conveyed in the conveying step (S9) by the roller pair 314.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

Modification

Although a preferred embodiment of the present disclosure has been described above, the present disclosure is not limited to the embodiment described above, and various design modifications can be made within the scope of the claims.

For example, in the above-described embodiment, each of the conveying unit 101 and the cutting unit 102 operates in accordance with the instruction from the external device 200, but is not limited thereto. For example, the external device 200 may send an instruction to the cutting unit 102, and the cutting unit 102 may send the instruction to the conveying unit 101 in accordance with the instruction.

A timing at which a controller shifts a first roller pair from a nip state to a nip release state may not be before a medium processing operation starts but before a medium reaches a nip position during the execution of the medium processing operation.

A timing at which the controller shifts the first roller pair from the nip release state to the nip state may not be after the medium processing operation ends and before a conveying operation starts, but when the medium is not at the nip position during the execution of the medium processing operation.

When the roller pair 314 shifts from the nip state to the nip release state, the upper roller 314*a* may be held at a fixed position and the lower roller 314*b* may be moved downward (in a direction away from the upstream path R1).

In the medium processing operation, the medium may not be conveyed in two directions and may be conveyed only in one direction (for example, a direction from the merging path R3 toward the downstream path R2).

The nip release state may be a state in which two rollers forming the first roller pair are in contact with each other as long as a nip force is smaller than that in the nip state. In this case, a pressing force applied from one to the other of the two rollers in the nip release state may be smaller than that in the nip state.

The medium is not limited to sheet, and may be cloth, a resin member, or the like.

The medium processing portion is not limited to a cutting portion that cuts the medium, and may be a recording portion that records an image on the medium (an ink jet head, a laser head, or the like).

The medium processing device according to the present disclosure is not limited to the cutting device, and may be a recording device or the like.

What is claimed is:

1. A medium processing device comprising:

a conveying portion configured to convey a medium along a conveyance path in a conveyance operation;

a medium processing portion configured to process the medium conveyed by the conveying portion; and a controller configured to control the conveying portion and the medium processing portion;

wherein the conveyance path comprises:

an upstream path;

a downstream path; and a merging path on which the upstream path and the downstream path are to be merged, the merging path comprising a processing position at which the medium is processed by the medium processing portion;

wherein the conveying portion comprises:

a first roller pair arranged on the downstream path and a second roller arranged on the merging path;

a third roller arranged on the upstream path;

wherein the first roller pair is configured to be set to a nip state during execution of the conveying operation;

wherein the first roller pair is configured to be set to a nip release state in which a nip force is smaller than that in the nip state during execution of a medium processing operation while the medium is positioned at a nip position of the first roller pair;

a first conveying motor configured to rotate the first roller pair and the third roller; and a second conveying motor configured to rotate the second roller;

wherein the first roller pair is configured to selectively taking the nip state or the nip release state in accordance with driving of the first conveying motor; and wherein the controller is configured to execute:

the medium processing operation causes the medium processing portion to process the medium while rotating the second roller to convey the medium in a state in which the medium is positioned over the merging path and the downstream path; and the conveying operation causes the first roller pair to rotate to convey the medium from the merging path toward the downstream path.

2. The medium processing device according to claim 1, wherein the nip release state is a state in which two rollers forming the first roller pair are separated from each other.

3. The medium processing device according to claim 2, wherein the controller is configured to shift the first roller pair from the nip release state to the nip state after the medium processing operation ends and before the conveying operation starts.

4. The medium processing device according to claim 1, wherein the controller is configured to convey, in the medium processing operation, the medium in a direction from the merging path toward the downstream path and a direction from the downstream path toward the merging path.

5. The medium processing device according to claim 4, wherein the medium processing portion is configured to cut the medium.

6. The medium processing device according to claim 5, wherein the controller is configured to shift the first roller pair from the nip release state to the nip state after the medium processing operation ends and before the conveying operation starts.

7. The medium processing device according to claim 4, wherein the controller is configured to shift the first roller pair from the nip release state to the nip state after the medium processing operation ends and before the conveying operation starts.

8. The medium processing device according to claim 1, wherein the first roller pair comprises:

a fourth roller; and a fifth roller located to sandwich the fourth roller between the fifth roller and the upstream path, and wherein the fourth roller is configured to move in a direction approaching the upstream path when the first roller pair shifts from the nip state to the nip release state.

9. The medium processing device according to claim 8, wherein the controller is configured to shift the first roller pair from the nip release state to the nip state after the medium processing operation ends and before the conveying operation starts.

10. The medium processing device according to claim 1, wherein the controller is configured to shift the first roller pair from the nip release state to the nip state after the medium processing operation ends and before the conveying operation starts.

11. The medium processing device according to claim 10, wherein the controller is configured to shift the first roller pair from the nip state to the nip release state before the medium processing operation starts.

12. The medium processing device according to claim 11, wherein the controller is configured to shift the first roller pair from the nip release state to the nip state after the medium processing operation ends and before the conveying operation starts.

13. A medium conveying unit comprising:

a first conveying portion configured to convey a medium along an upstream path and a downstream path; and a controller configured to control the first conveying portion;

wherein the medium conveying unit is configured to be attached to a medium processing unit, the medium processing unit comprising a second conveying portion configured to convey the medium along a merging path on which the upstream path and the downstream path are to be merged, and a medium processing portion configured to process the medium conveyed by the second conveying portion at a processing position provided on the merging path;

wherein the first conveying portion comprises a first roller pair arranged on the downstream path, and a third roller arranged on the upstream path;

wherein the second conveying portion comprises a second roller arranged on the merging path;

wherein a first conveying motor is configured to rotate the first roller pair and the third roller, and a second conveying motor is configured to rotate the second roller;

wherein the controller is configured to execute a conveying operation to cause the first roller pair to rotate to convey the medium from the merging path toward the downstream path, wherein the first roller pair is configured to be set to a nip state during execution of the conveying operation, and wherein the first roller pair is configured to be set to a nip release state in which a nip force is smaller than that in the nip state during execution of a medium processing operation while the medium is positioned at a nip position of the first roller pair, the medium processing operation being executed to cause the medium processing portion to process the medium while rotating the second roller to convey the medium in a state in which the medium is positioned over the merging path and the downstream path; and wherein the first roller pair is configured to selectively taking the nip state or the nip release state in accordance with driving of the first conveying motor.

14. The medium processing device according to claim 13, wherein the controller is configured to shift the first roller pair from the nip release state to the nip state after the medium processing operation ends and before the conveying operation starts.

* * * * *